US008782816B2

(12) United States Patent
Bielobocky

(10) Patent No.: US 8,782,816 B2
(45) Date of Patent: Jul. 22, 2014

(54) FASHION SCARF WITH INNER WIRING

(75) Inventor: Ruth Marie Bielobocky, Frederick, MD (US)

(73) Assignee: Ion Design LLC, Frederick, MD (US)

( * ) Notice: Subject to any disclaimer, the term of this patent is extended or adjusted under 35 U.S.C. 154(b) by 12 days.

(21) Appl. No.: 13/402,351

(22) Filed: Feb. 22, 2012

(65) Prior Publication Data

US 2012/0210492 A1 Aug. 23, 2012

Related U.S. Application Data

(60) Provisional application No. 61/463,765, filed on Feb. 23, 2011.

(51) Int. Cl.
*A42B 5/00* (2006.01)

(52) U.S. Cl.
USPC ..... 2/207

(58) Field of Classification Search
USPC ..... 2/207, 208, 175.4, 195.4, 244, 311, 2/321, 171
See application file for complete search history.

(56) References Cited

U.S. PATENT DOCUMENTS

| | | | | |
|---|---|---|---|---|
| 37,247 | A | | 12/1862 | Saroni |
| 73,790 | A | | 1/1868 | Fisk et al. |
| D11,780 | S | | 5/1880 | Flagg |
| 613,551 | A | | 11/1898 | Bandler et al. |
| 1,097,491 | A | | 5/1914 | Wasen |
| 1,970,495 | A | * | 8/1934 | Deich ..... 2/91 |
| 2,048,880 | A | | 1/1936 | Morgan |
| 2,064,222 | A | | 12/1936 | Roseman |
| 2,413,319 | A | | 12/1946 | Golfieri et al. |
| 2,494,250 | A | * | 1/1950 | Loven ..... 2/91 |
| D169,083 | S | | 3/1953 | Neumann |
| 3,172,331 | A | | 3/1965 | Nole et al. |
| 3,201,803 | A | | 8/1965 | Gettinger |
| 3,286,276 | A | | 11/1966 | Calisch |
| 3,360,802 | A | | 1/1968 | Kasamatsu |
| 3,471,867 | A | | 10/1969 | Kirchhoff |
| 4,321,709 | A | | 3/1982 | Steinberg |
| 4,404,688 | A | | 9/1983 | Knight |
| 4,788,722 | A | | 12/1988 | Oliver |
| 4,894,865 | A | | 1/1990 | Ieraci |
| 4,942,627 | A | | 7/1990 | Copprue |
| 5,233,704 | A | | 8/1993 | Booher |
| D353,252 | S | | 12/1994 | Shostal et al. |
| 5,655,224 | A | | 8/1997 | Sears |
| 5,802,618 | A | | 9/1998 | Mustata |
| 5,867,833 | A | | 2/1999 | LeDonne |
| 6,065,156 | A | | 5/2000 | Murphy |
| 6,145,131 | A | | 11/2000 | Huff |
| 6,226,799 | B1 | | 5/2001 | Lane |
| 6,341,504 | B1 | | 1/2002 | Istook |
| 7,503,079 | B1 | | 3/2009 | Fletcher et al. |
| 7,654,116 | B1 | * | 2/2010 | Trelease ..... 66/176 |
| 2007/0017004 | A1 | | 1/2007 | Sims-Perry |
| 2007/0118971 | A1 | | 5/2007 | Blecha |
| 2008/0172770 | A1 | | 7/2008 | Clark |
| 2009/0106878 | A1 | | 4/2009 | Hiskey |

(Continued)

*Primary Examiner* — Tejash Patel
(74) *Attorney, Agent, or Firm* — Nevrivy Patent Law Group P.L.L.C.

(57) ABSTRACT

The present invention provides a scarf comprising one or more pieces of fabric comprising one or more moldable wires that are located along at least two sides of the scarf enabling the scarf to be sculpted into a desired shape around the neck and shoulders of a user.

17 Claims, 16 Drawing Sheets

(56) References Cited

U.S. PATENT DOCUMENTS

| | | | |
|---|---|---|---|
| 2009/0126078 | A1 | 5/2009 | Rashid |
| 2009/0210993 | A1 | 8/2009 | Pendleton |
| 2010/0000008 | A1 | 1/2010 | Lewis |
| 2010/0257658 | A1 | 10/2010 | Schwietz-Flauto |
| 2010/0313331 | A1 | 12/2010 | English |

* cited by examiner

FASHION SCARF WITH INNER WIRING

CROSS-REFERENCE TO RELATED APPLICATIONS

This application claims the benefit of U.S. Provisional Application No. 61/463,765, filed Feb. 23, 2011. The content of the aforementioned application is relied upon and is incorporated by reference in its entirety.

BACKGROUND OF THE INVENTION

1. Field of the Invention

The field of the invention relates to fabrics and apparel, in particular women's fashion scarves.

2. Description of the Related Art

A scarf comprises a piece of fabric generally worn around the neck, or near the head or around the waist for warmth, cleanliness, fashion or for religious reasons. Scarves can come in a variety of different colors and have different patterns or designs. Fashion scarves are placed around the neck of a user and folded or styled in various ways. However, all too frequently, the scarf does not hold its desired shape and often requires constant tugging, pulling, repositioning and/or tying of the scarf on the neck and shoulders of the user. Moreover, the scarves cannot be permanently sculpted and the number of ways in which the scarf can be tied is limited.

U.S. Pat. No. 5,233,704 relates to a scarf or other band-like apparel member which includes a pliable metal wire positioned interiorly of the scarf and is adapted to be adjusted to the proper neck size of the wearer since the pliable metal wire which forms part of the scarf can be twisted to adjust the size of the scarf to the proper neck size.

What is needed is a hassle-free fashion scarf which enables the user to create a freestyle sculpting design around the entire neck and shoulders of a user throughout the entire length of the scarf and which can be wrapped, styled, twisted and/or squeezed to create fresh new looks in fun and easy ways.

This background information is provided for the purpose of making information believed by the applicant to be of possible relevance to the present invention. No admission is necessarily intended, nor should it be construed, that any of the preceding information constitutes prior art against the present invention.

SUMMARY OF THE INVENTION

In one aspect, the invention provides a scarf which enables the user to create a freestyle sculpting design around their neck and shoulders.

In another aspect, the invention provides a scarf comprising one or more pieces of fabric comprising one or more moldable wires that are located along at least two sides of the scarf enabling the scarf to be sculpted into a desired shape around the neck and shoulders of a user.

In another aspect, the scarf is capable of being sculpted into a desired shape, and comprises a front comprising a first piece of fabric and a back comprising a second piece of fabric, wherein the first and second pieces of fabric are attached together forming a scarf with a substantially quadrilateral shape with four sides; wherein at least two sides comprise a moldable wire, wherein the wire is positioned at the periphery of the side and extends substantially along the entire length of the side of the scarf.

It is to be understood that both the foregoing general description of the invention and the following detailed description are exemplary, and thus do not restrict the scope of the invention.

BRIEF DESCRIPTION OF THE DRAWINGS

The skilled artisan will understand that the drawings, described below, are for illustration purposes only. The drawings are not intended to limit the scope of the present teachings in any way.

DETAILED DESCRIPTION

Figure 1:
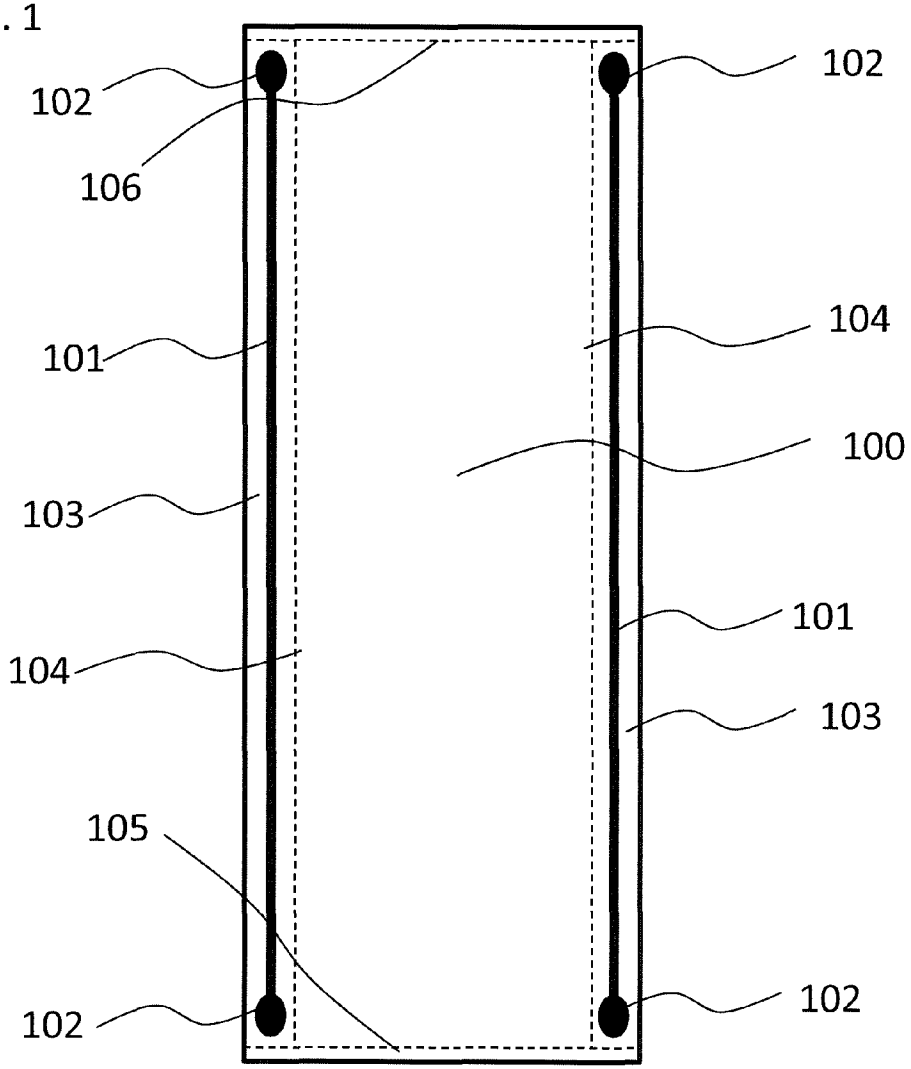
FIG. 1 shows an embodiment of a wired fashion scarf 100.
Figure 2:
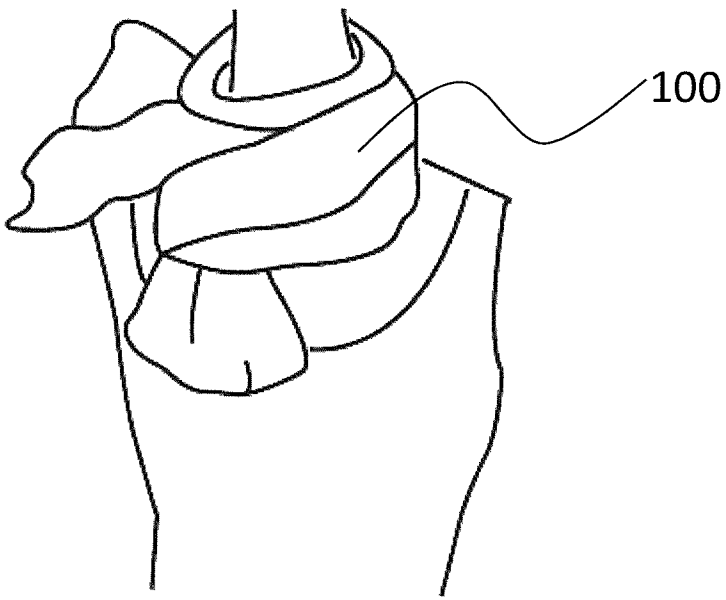
FIG. 2 shows how the scarf can be styled in accordance with one embodiment.
Figure 3:
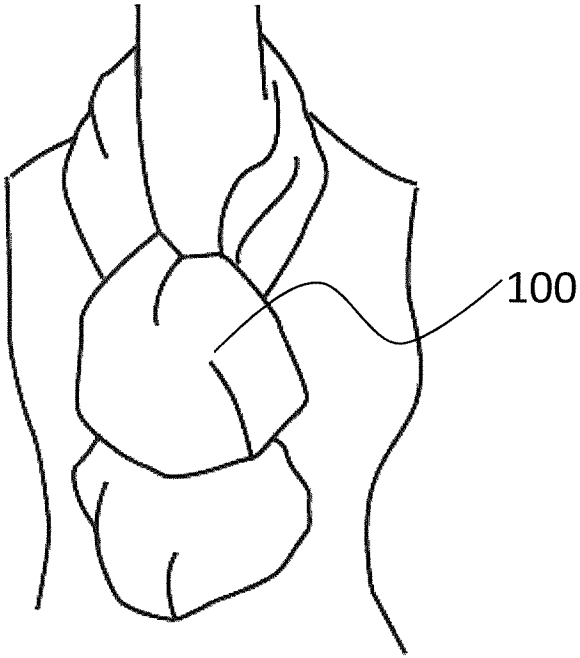
FIG. 3 shows how the scarf can be styled in accordance with one embodiment.
Figure 4:
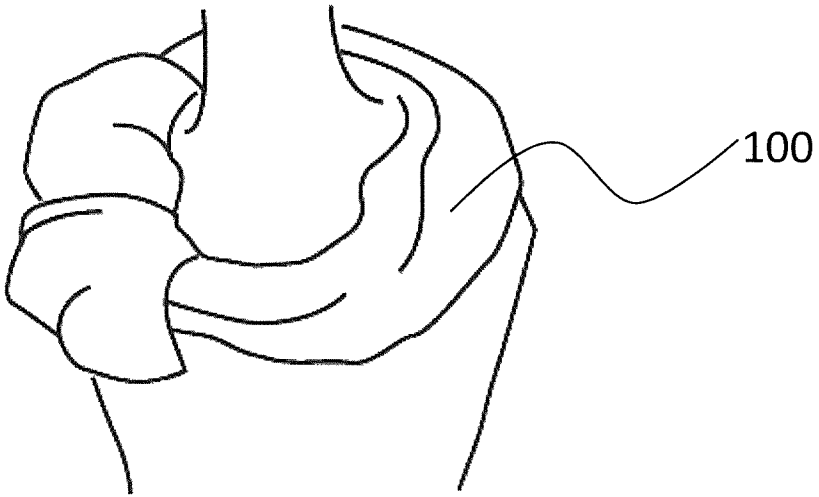
FIG. 4 shows how the scarf can be styled in accordance with one embodiment.
Figure 5:
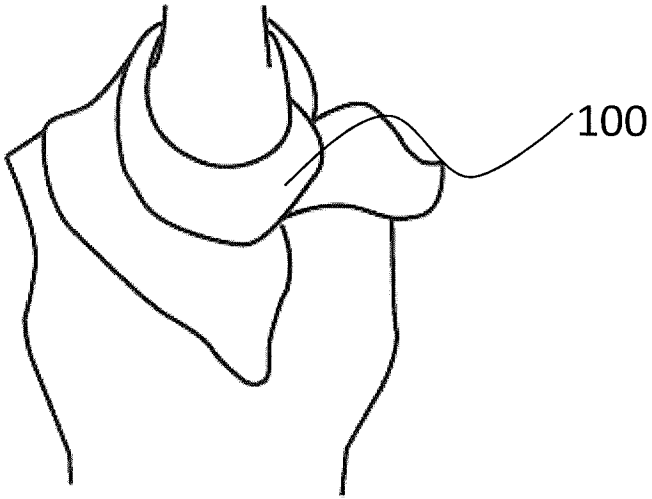
FIG. 5 shows how the scarf can be styled in accordance with one embodiment.
Figure 6:
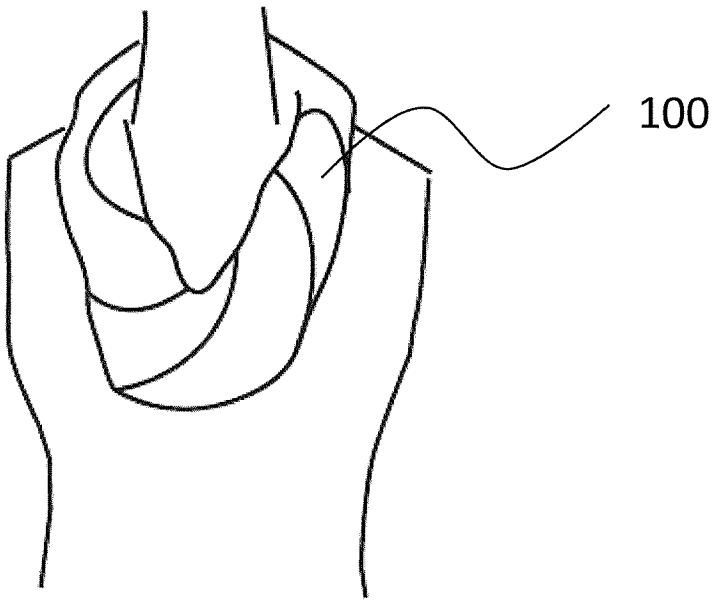
FIG. 6 shows how the scarf can be styled in accordance with one embodiment.
Figure 7:
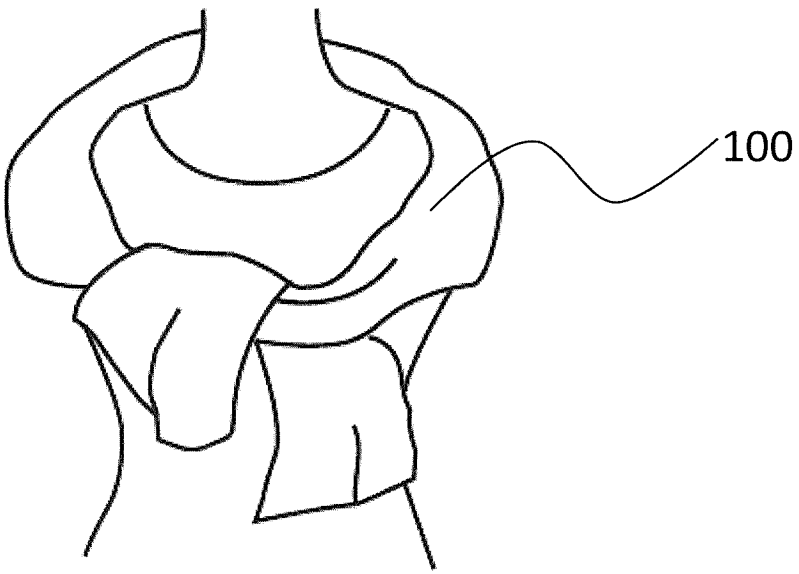
FIG. 7 shows how the scarf can be styled in accordance with one embodiment.
Figure 8:
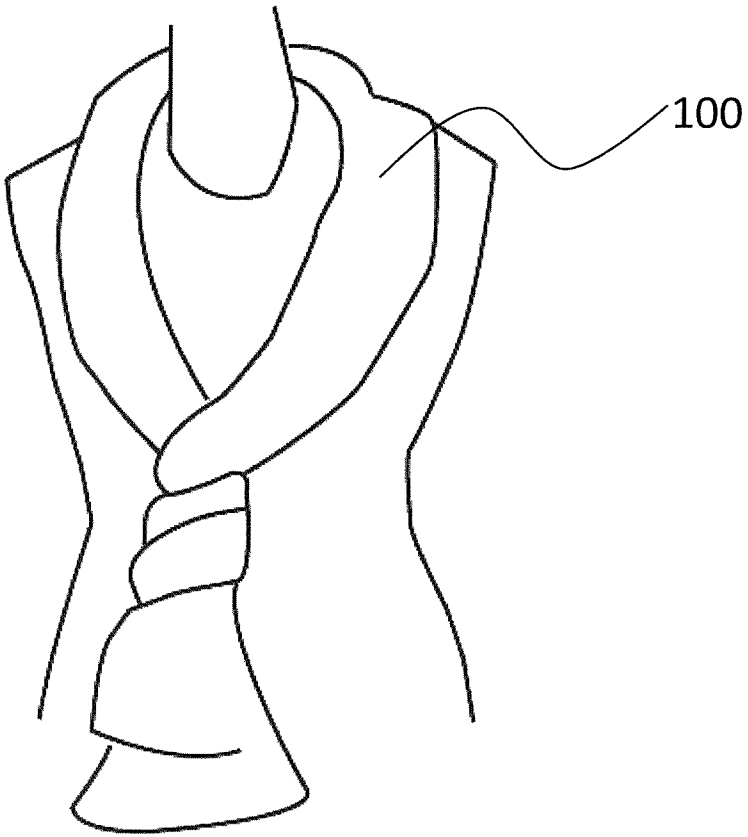
FIG. 8 shows how the scarf can be styled in accordance with one embodiment.
Figure 9:
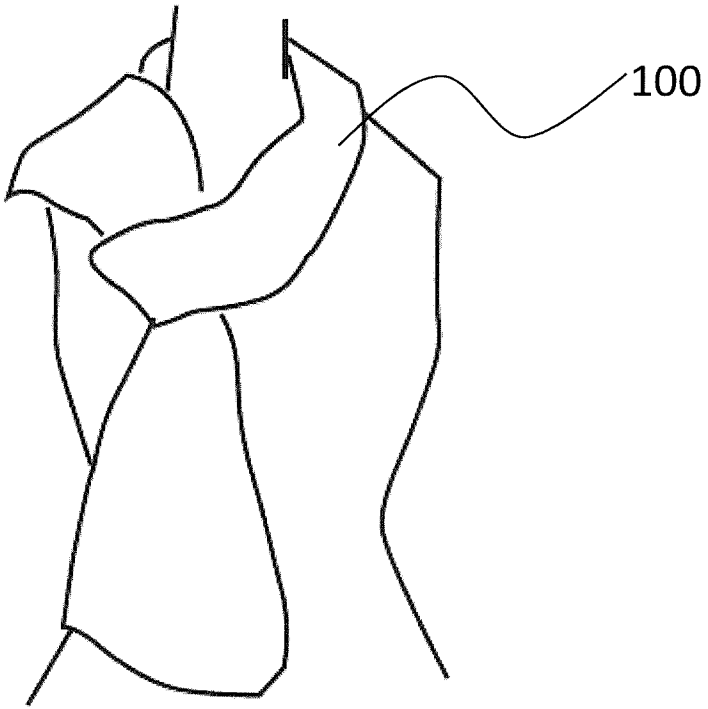
FIG. 9 shows how the scarf can be styled in accordance with one embodiment.

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated article of manufacture, and further applications of the principles of the invention as illustrated therein are herein contemplated as would normally occur to one skilled in the art to which the invention relates.

Unless defined otherwise, all technical and scientific terms used herein have the same meaning as commonly understood by one of ordinary skill in the art to which this invention pertains.

For the purpose of interpreting this specification, the following definitions will apply and whenever appropriate, terms used in the singular will also include the plural and vice versa. In the event that any definition set forth below conflicts with the usage of that word in any other document, including any document incorporated herein by reference, the definition set forth below shall always control for purposes of interpreting this specification and its associated claims unless a contrary meaning is clearly intended (for example in the document where the term is originally used). The use of "or" means "and/or" unless stated otherwise. The use of "a" herein means "one or more" unless stated otherwise or where the use of "one or more" is clearly inappropriate. The use of "comprise," "comprises," "comprising," "include," "includes," and "including" are interchangeable and not intended to be limiting. Furthermore, where the description of one or more embodiments uses the term "comprising," those skilled in the art would understand that, in some specific instances, the embodiment or embodiments can be alternatively described using the language "consisting essentially of" and/or "consisting of."

As used herein, the term "about" refers to a ±10% variation from the nominal value. It is to be understood that such a variation is always included in any given value provided herein, whether or not it is specifically referred to.

The present invention provides a fashion scarf which enables the user to create a freestyle sculpting design around their neck and shoulders. The entire scarf can be shaped and molded in a way the user wants it to look and it holds its position.

The scarf comprises one or more pieces of fabric comprising one or more moldable wires that are located along at least two sides of the scarf enabling the scarf to be shaped and molded into a fixed position. The scarf provides the user with the ability to design many new and unique styles as well as conventional styles. The wires are easy to bend and control and remain relatively fixed in place. In some embodiments, the scarf can be wrapped, styled, twisted and/or squeezed to create fresh new looks in a fun and easy way.

In some embodiments, the scarf has a quadrilateral shape having four sides or edges. In some embodiments, the scarf has a oblong shape with two longer sides having approximately equal length and two shorter sides having approximately equal length. In some embodiments, the scarf has a square shape. In some embodiments, the scarf has a triangular shape. Persons of skill in the art will appreciate that shapes that are substantially the same as the above noted shapes are encompassed by the invention. For example, the corners of the scarf can be rounded, instead of being at a defined angle.

The scarf can comprise one or more pieces of fabric. In some embodiments, the scarf has a front and a back and comprises two pieces of fabric. In some embodiments, one piece of fabric is on the front side and one piece is on the back side and the two pieces are sewn or stitched together. In some embodiments, having two pieces of fabric makes the scarf "reversible" which enables the user to accessorize using the scarf to a greater extent possible than with a scarf made from only one piece of fabric, since different pieces of fabric having different designs, color schemes and/or patterns can be combined. In some embodiments, the two pieces of fabric are made from the same type of material and have the same color scheme, design and/or pattern. In some embodiments, the two pieces of fabric are made from the same type of material but have a different colors, designs and/or patterns. In some embodiments, the two pieces of fabric are made from different types of material. The nature of the design, color scheme and/or pattern of the fabric is not limiting.

In some embodiments, the invention provides a scarf that is capable of being sculpted into a desired shape, comprising a front comprising a first piece of fabric and a back comprising a second piece of fabric, wherein the first and second pieces of fabric are attached together forming a scarf with a quadrilateral shape with four sides or edges; wherein at least two sides or edges comprise a moldable wire, wherein each wire is positioned at the periphery of the side or edge and extends substantially along the entire length of the side or edge of the scarf, wherein the wires facilitate the freestyle sculpting of the scarf into the desired design around the neck and shoulders of a user.

The type of fabric that can be used to make the scarf is not limiting. In some embodiments, the fabric is made from a material selected from the group consisting of satin charmeuse, cotton, brocade, silk, chambray, challis, cendal, chiffon, nylon, georgette voile, crepe, crepon, damask, organza, satin, shantung, marocain, satinet, dupion, silkaline, velvet, velour, imitation suede, voile, poly silk and a suitable blend of different fibers, including the aforementioned materials.

The size of the scarf or the pieces of fabric from which the scarf is made is not limiting. In some embodiments, the finished scarf is about 25 inches to about 85 inches by about 5 inches to about 45 inches in size. In some embodiments, the finished scarf is about 45 inches to about 65 inches by about 8 inches to about 25 inches in size. In some embodiments, the finished scarf is about 50 inches to about 60 inches by about 10 inches to about 15 inches in size. In some embodiments, the finished scarf is about 10 inches by about 58.5 inches in size. In some embodiments, the finished scarf is about 10 inches by about 54 inches in size.

In some embodiments, the one or more pieces of fabric are about 28 inches to about 90 inches by about 6 inches to about 48 inches in size. In some embodiments, the one or more pieces of fabric are about 48 inches to about 70 inches by about 10 inches to about 25 inches in size. In some embodiments, the one or more pieces of fabric are about 53 inches to about 65 inches by about 12 inches to about 18 inches in size. In some embodiments, the one or more pieces of fabric are about 55.5 inches by about 10 inches in size. In some embodiments, the one or more pieces of fabric are about 56.5 inches by about 11 inches in size before being hemmed or sewn together. In some embodiments, the fabric is cut from a 58" roll of fabric.

In some embodiments, a scarf comprising two pieces of fabric is made according to a process comprising one or more of the following steps. The first and second pieces of fabric can be cut according to the desired dimensions or size, e.g. 56.5 inches by 11 inches. The two pieces of fabric are attached, e.g., sewn with their right sides together on three sides. By "right side" is meant the side of the fabric which is intended to show on the exterior of the scarf, which normally has a finer and/or more finished look or appearance. If the scarf is oblong in shape, in some embodiments, the three sides that are sewn or stitched together are typically the two longer sides and one of the shorter sides. In some embodiments, the fabric is stitched together on the three sides with a seam of about 0.25 to about 3.5 inches. In some embodiments, the fabric is stitched together on the three sides with a seam of about 0.5 inches on each side. The two pieces of fabric can then be turned with their right sides facing out to the exterior. If the scarf is oblong in shape, in some embodiments, one of the long sides can be top stitched in order to create a sleeve at the periphery of the side of the scarf for the wire to be housed or inserted, e.g., in some embodiments, of about 0.15 inches to about 0.75 inches from the periphery or edge. In some embodiments, the top stitching is about 0.25 inches from the periphery or edge. In the case of an oblong shape scarf, in some embodiments, one of the shorter sides is then top stitched, e.g., of about 0.15 inches to about 0.75 inches from the periphery or edge. In some embodiments, the top stitching of the shorter side is about 0.25 inches from the periphery or edge. In some embodiments, the other long side can then be top-stitched, e.g., in accordance with the top stitching of the other long side as discussed above. The wires can be inserted though the open ended side of the scarf and positioned at the periphery of the sides of the scarf before or after the top stitching. For example, the wires can be inserted into the sleeve or housing that is created by the top stitching of the long side through the open shorter side. In other embodiments, the wire is first placed into position at the periphery of the side and then the sleeve or housing is created by the top stitching. Once the wires are inserted, the last side of the scarf can be closed, e.g., with a seam of about 0.25 to about 3.5 inches. In some embodiments, the last side is closed with a seam of about 0.5 inches to about 0.75 inches. In some embodiments, the stitching is from about 5-20 stitches per inch. In some embodiments, the stitching is about 10 stitches per inch.

In some embodiments, the scarf is made from a single piece of fabric. In some embodiments, the edge of the piece of fabric is hemmed in along the edge of the fabric creating a sleeve or housing which the wire is inserted in and the edge is then closed. In some embodiments, the stitching of the hem is typically about 0.25 inches to about 3.5 inches from the edge, or from about 0.5 inches to about 0.75 inches from the edge.

The wire that can be incorporated in the scarf is not limiting, provided it is moldable. In some embodiments, the moldable wire comprises a metal selected from the group consisting of stainless steel, such as galvanized stainless steel (recooked), copper, aluminum, tin, titanium, and a metal alloy such as, for example, brass (copper and zinc) or bronze (copper and tin). In some embodiments, the wire has a diameter of about 0.3 mm to about 1.5 mm. In some embodiments, the size of the wire is about 0.8 mm.

The wire is positioned at the periphery of the side of the scarf and extends substantially along the entire length of the side of the scarf. In some embodiments, the length of the wire is about 90% of the length of the side of the scarf where it is positioned. In some embodiments, the length of the wire is about 91%, about 92%, about 93%, about 94%, about 95%, about 96%, about 97%, about 98% or about 99% of the length of the side of the scarf where it is positioned. In some embodiments, the difference between the length of the sleeve or housing and the wire is about 1 to about 3 inches or less. In some embodiments, the difference between the length of the sleeve or housing and the wire is about 1.5 inches or less. Having the wires extend substantially along the entire sides of the scarf permit a greater degree of freestyle sculpting resulting in unique designs or designs that better hold their shape along the entire length of the scarf.

In some embodiments, the wires are modified to prevent puncturing of the fabric. In some embodiments, the tips of the wires are coated, for example, with a polymer which prevents puncturing of the fabric. In some embodiments, the coating creates a tip of the wire having a bulbous or rounded shape that does not puncture the fabric. In some embodiments, the wires or tips of the wire are coated with a thermoreactive polymer, such as a RILSAN polymer. In some embodiments, the tips of the wire are coated by warming the ends followed by contacting the ends with the thermoreactive polymer. The powder form RILSAN polymer sticks to the ends of the wire and melts onto the wire due to the heat of the wire. The dipping and melting process can be performed one or more times to create a bulbous shaped end that does not puncture the fabric. Other means can also be employed to modify the tips of the wire to prevent puncturing. For example, in some embodiments, a soft material such as rubber can be affixed to the tip of the wire. In some embodiments, a soft tubing material can be inserted on the ends of the wires. The modifications of the wire can also facilitate the grasping and positioning of the wire.

The scarf comprises one or more wires that are present on at least two sides of the scarf. In some embodiments, two wires are positioned on opposite sides or edges of the scarf such that the wires are substantially parallel to one another. In some embodiments, the scarf has an oblong shape with two shorter sides and two longer sides and two wires positioned at the periphery of the two longer sides. In some embodiments, one or more wires are present on three sides of the scarf. In some embodiments, one or more wires are present on all four sides of the scarf. In some embodiments, the wires can comprise one contiguous wire that is molded at the periphery of more than one side, or can comprise multiple individual wires present on each side or a combination thereof, such as, for example, one wire positioned at the periphery of three sides and a second wire positioned at the periphery of the fourth side.

Referring now to FIG. 1, there is shown a scarf 100. The scarf comprises moldable wires 101 positioned at the periphery on two sides of the scarf. The wires 101 are coated with a polymer at the tips 102 creating a bulbous shape which prevents puncturing of the fabric. The wire 101 is placed into a sleeve or housing 103 that is created at the periphery of the side of the scarf by top stitching the two pieces of fabric and creating a seam 104 at an edge or at side of the scarf. The sleeve or housing 103 is closed at the bottom end by seam 105 which can be top stitched. Once the wires have been inserted, the sleeve or housing 103 can be closed at the top portion by creating a seam 106.

The scarf can be styled in a number of ways as shown in FIGS. 2-15.

Figure 10:
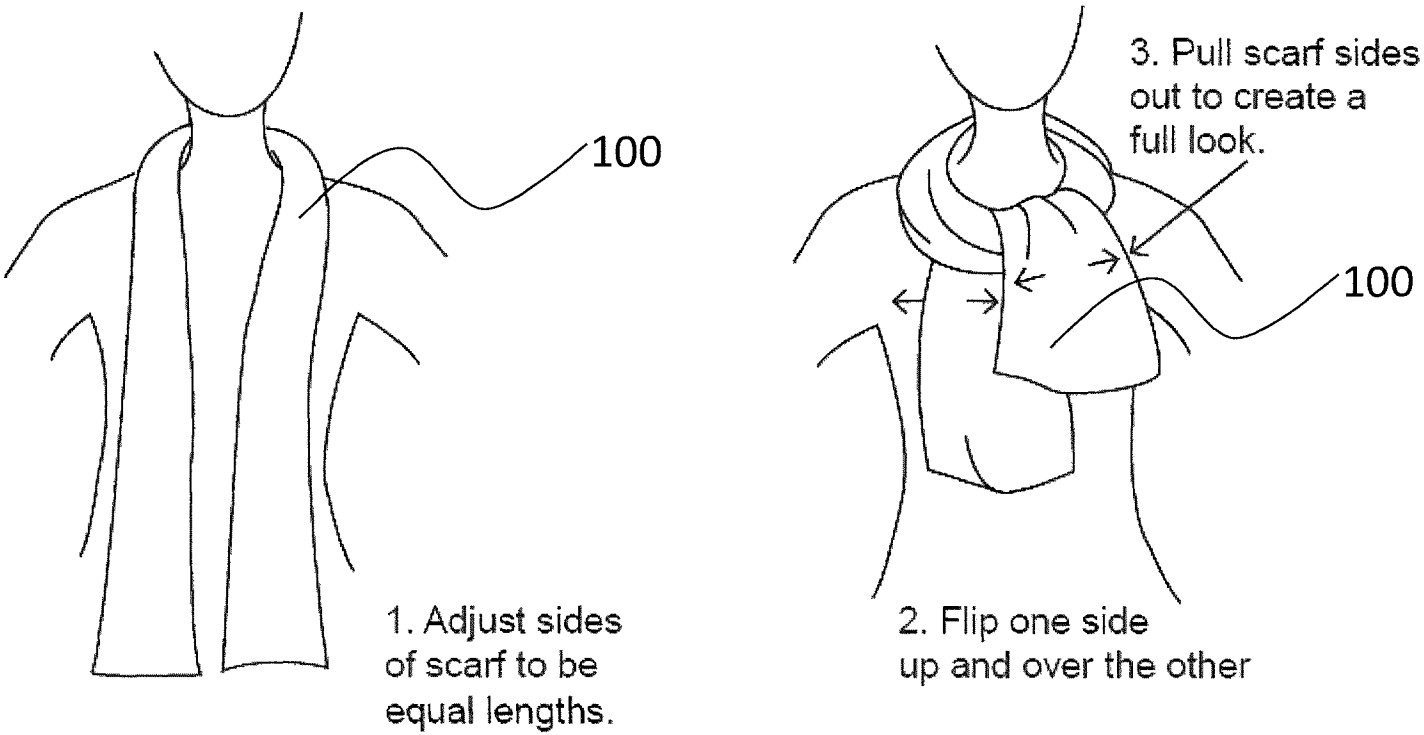
FIG. 10 shows an instruction on how to style the scarf to create a look called "The Big Flip."

In some embodiments, the scarf can be styled to create a look called "The Big Flip." As shown in FIG. 10, to create this look, the scarf sides are adjusted around the neck to be of equal length. One side is flipped over the other side and the sides of the scarf are pulled out to create a full look.

Figure 11:
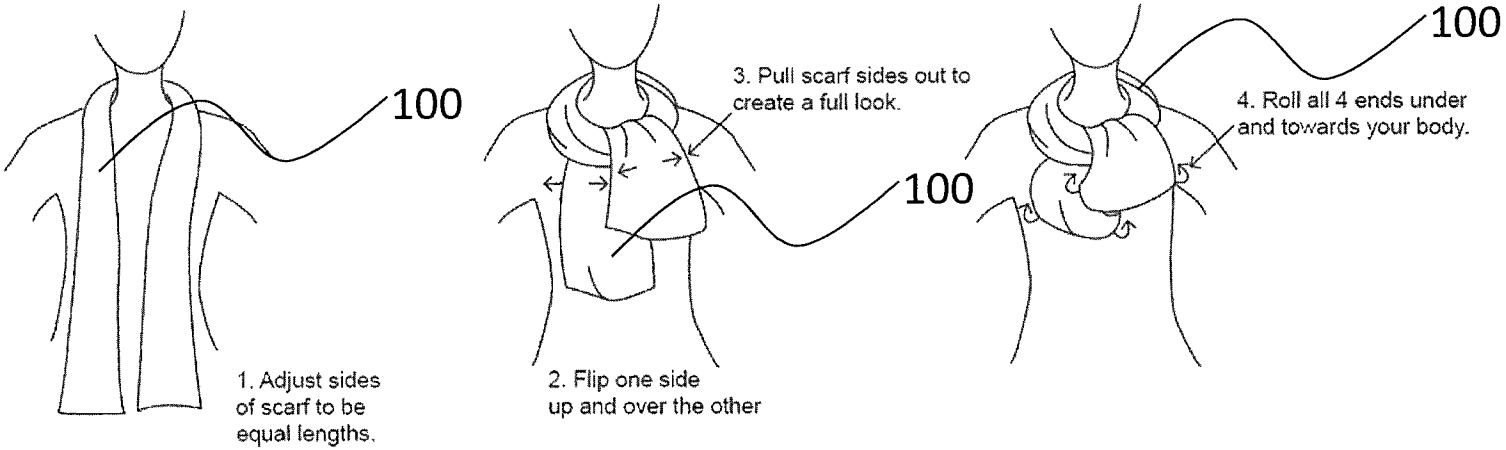
FIG. 11 shows an instruction on how to style the scarf to create a look called "Shoulder Flower."

In some embodiments, the scarf can be styled to create a look called "Shoulder Flower." As shown in FIG. 11, to create this look, the scarf sides are adjusted around the neck to be of equal length. One side is flipped over the other side and the sides of the scarf are pulled out to create a full look. The final step is rolling all four ends under and towards the user's body.

Figure 12:
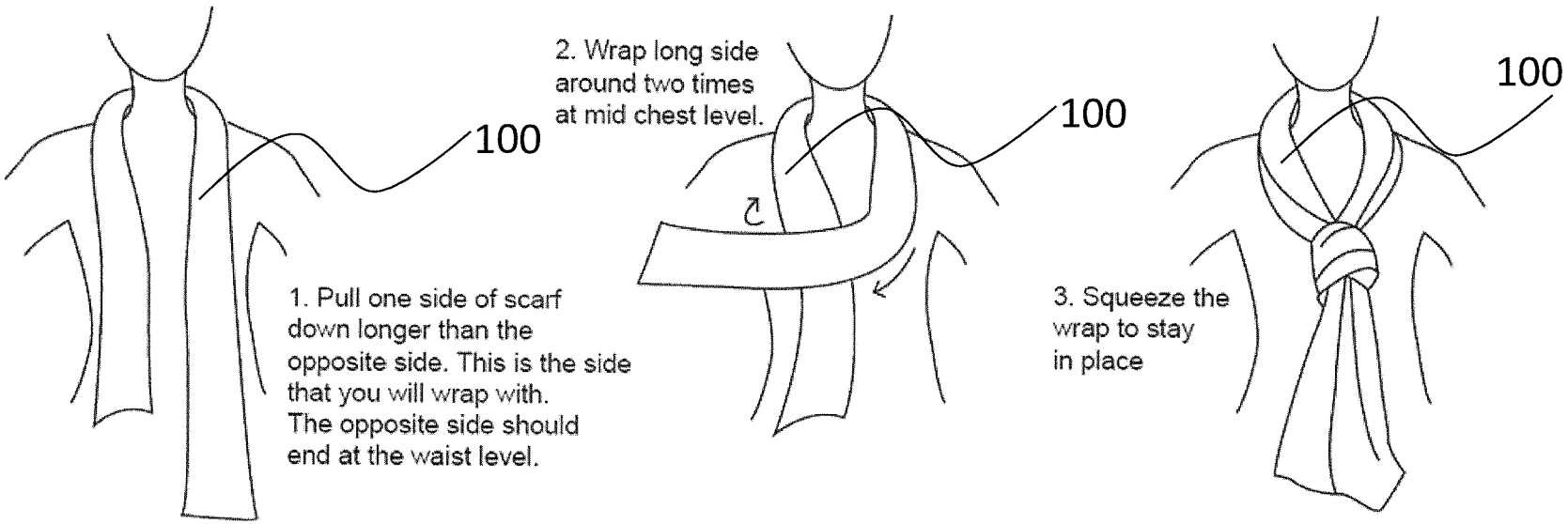
FIG. 12 shows an instruction on how to style the scarf to create a look called "Necktie."

In some embodiments, the scarf can be styled to create a look called "Necktie." As shown in FIG. 12, to create this look, one side of the scarf is pulled down longer than the opposite side. The longer side is the side that is wrapped with while the opposite side should end at about waist level. The long side is wrapped two times at mid chest level and then the wrap is squeezed to stay in place.

Figure 13:
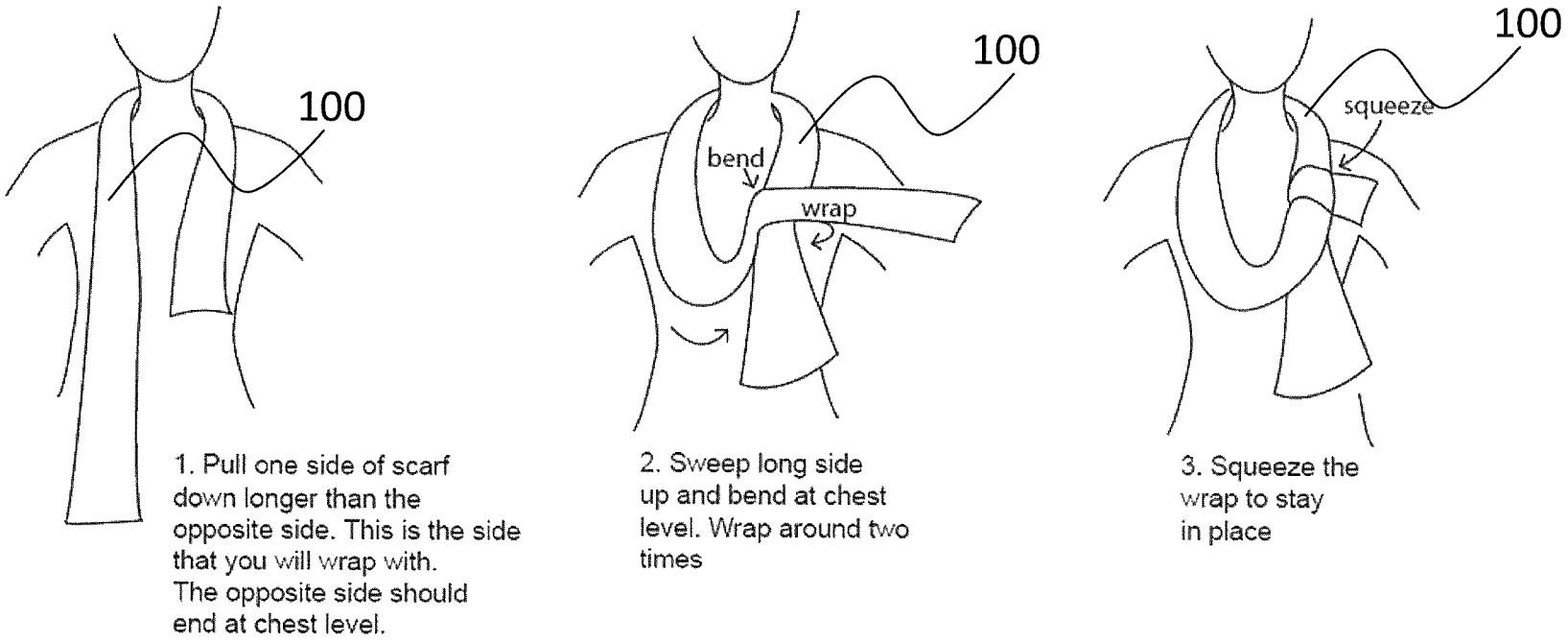
FIG. 13 shows an instruction on how to style the scarf to create a look called "Side Sweep."

In some embodiments, the scarf can be styled to create a look called "Side Sweep." As shown in FIG. 13, to create this look, one side of the scarf is pulled down longer than the opposite side. The longer side is the side that is wrapped with while the opposite side should end at about chest level. The long side is swept up and bent at the chest level and wrapped around the short side two times. The wrap is squeezed to stay in place.

Figure 14:
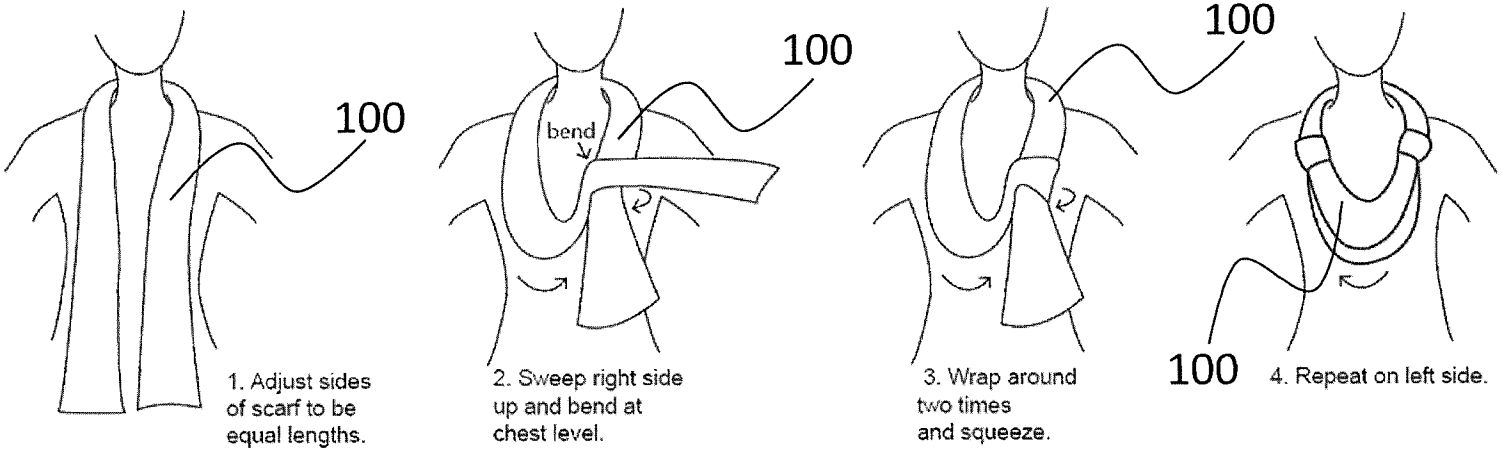
FIG. 14 shows an instruction on how to style the scarf to create a look called "Double Knot."

In some embodiments, the scarf can be styled to create a look called "Double Knot." As shown in FIG. 14, to create this look, the scarf sides are adjusted around the neck to be of equal length. The right side is swept up and bent at the chest level and wrapped around the other side two times and the wrap is squeezed to stay in place. The same process is repeated on the left side.

Figure 15:
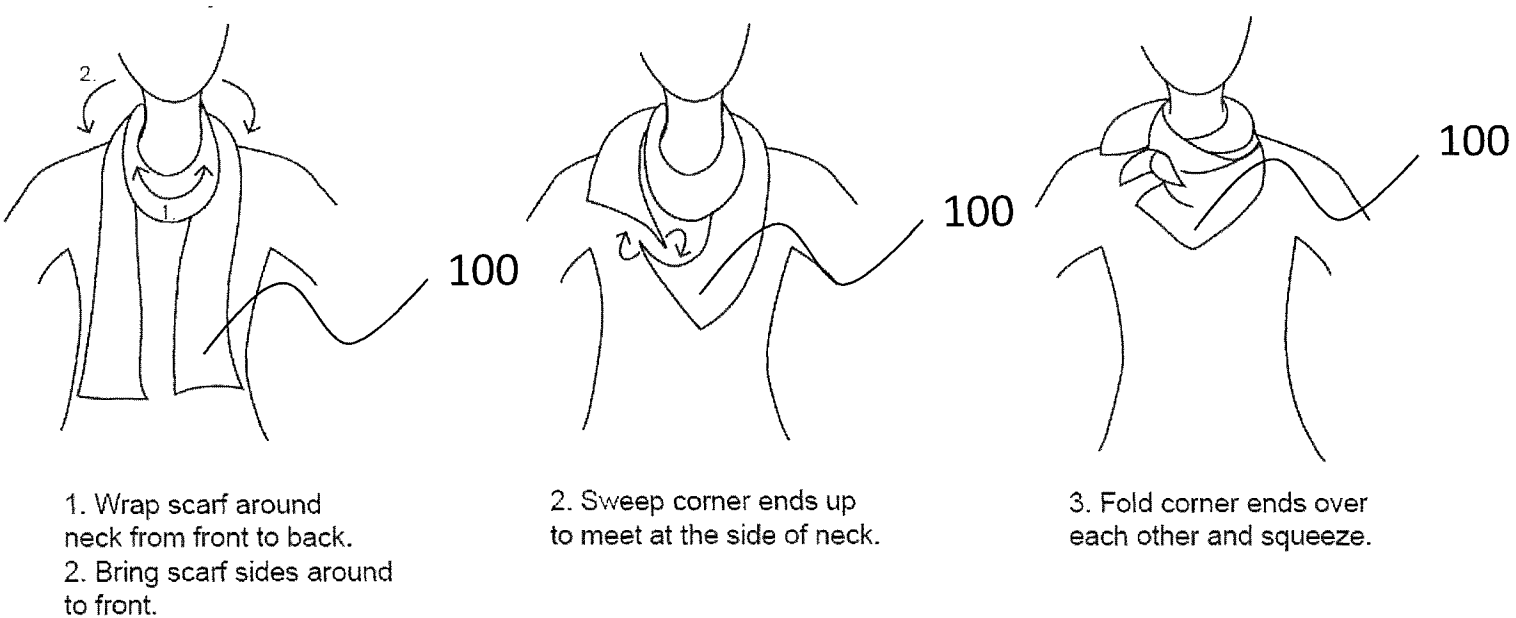
FIG. 15 shows an instruction on how to style the scarf to create a look called "Double Wrap & Tie."
Figure 16:
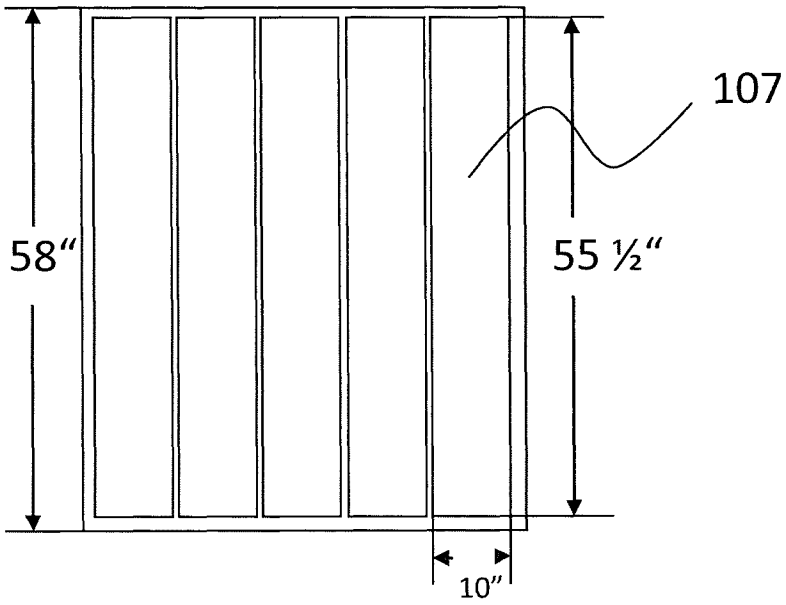
FIG. 16 shows an exemplary marker from which pieces of fabric 107 can be cut to make the scarf.

In some embodiments, the scarf can be styled to create a look called "Double Wrap & Tie." As shown in FIG. 15, to create this look, the scarf is wrapped around the neck from front to back and the scarf sides are brought around to the front. The corner ends are swept up to meet at the side of the neck. The corner ends are then folded over each other and squeezed to hold them in place.

All references, including publications, patent applications, and patents, cited herein are hereby incorporated by reference to the same extent as if each reference were individually and specifically indicated to be incorporated by reference and were set forth in its entirety herein.

What is claimed is:

1. A neck and/or shoulder scarf that is capable of being sculpted into a desired shape, comprising one or more pieces of fabric wherein at least one piece of fabric forms a scarf with a substantially quadrilateral shape with four sides; wherein at least two of the sides of the scarf comprise one or more moldable wires generally positioned at the periphery of said sides and extends substantially along the entire length of the scarf, and wherein at least a portion of the one or more wires is coated to prevent puncturing of fabric.

2. The scarf of claim 1, wherein the first piece of fabric and second piece of fabric are about 56.5 inches by about 11 inches before being stitched together.

3. The scarf of claim 1, wherein the one or more coated moldable wires comprises a polymer at the ends of the wire.

4. The scarf of claim 3, wherein the polymer is a thermoreactive polymer.

5. The scarf of claim 4, wherein the polymer is RILSAN polymer.

6. The scarf of claim 1, wherein the one or more moldable wires comprise stainless steel.

7. The scarf of claim 1, wherein the at least two sides comprise one or more moldable wires being substantially parallel to each other.

8. The scarf of claim 1, wherein three sides comprises a moldable wire.

9. The scarf of claim 1, wherein the quadrilateral scarf is substantially square.

10. The scarf of claim 1, wherein the quadrilateral scarf has an oblong shape with two longer sides and two shorter sides.

11. The scarf of claim 1, wherein the fabric is selected from the group consisting of satin charmeuse, brocade, silk, cotton, chambray, challis, cendal, chiffon, nylon, georgette voile, crepe, crepon, damask, organza, satin, shantung, marocain, satinet, dupion, silkaline, velvet, velour, imitation suede, voile and poly silk.

12. The scarf of claim 1, wherein the scarf has a length of from about 25 inches to about 85 inches and a width of from about 5 inches to about 25 inches.

13. The scarf of claim 1, where the scarf is about 10 inches by about 54 inches.

14. The scarf of claim 3, wherein the polymer coating on the ends of the wire has a bulbous shape.

15. The scarf of claim, wherein the one or more moldable wires comprise a metal selected from the group consisting of galvanized stainless steel (re-cooked), copper, aluminum, tin, titanium, metal alloy, brass (copper and zinc) and bronze (copper and tin).

16. The scarf of claim 1, wherein the one or more moldable wires have a diameter of about 0.3 mm to about 1.5 mm.

17. The scarf of claim 15, wherein the one or more moldable wires have a diameter of about 0.8 mm.

* * * * *